US005939210A

United States Patent [19]

Hirose et al.

[11] Patent Number: 5,939,210

[45] Date of Patent: Aug. 17, 1999

[54] RECORDING PAPER, INK-JET RECORDING PROCESS AND RECORDING SYSTEM MAKING USE OF THE RECORDING PAPER

[75] Inventors: Mifune Hirose, Machida; Eiichi Suzuki, Asaka; Mamoru Sakaki, Yamato; Masato Katayama, Yokohama, all of Japan

[73] Assignee: Canon Kabushiki Kaisha, Tokyo, Japan

[21] Appl. No.: 08/720,449

[22] Filed: Sep. 30, 1996

Related U.S. Application Data

[62] Division of application No. 08/398,764, Mar. 6, 1995, Pat. No. 5,591,514.

[30] Foreign Application Priority Data

| | | | |
|---|---|---|---|
| Mar. 8, 1994 | [JP] | Japan | 6-37004 |
| Mar. 8, 1994 | [JP] | Japan | 6-37005 |
| Mar. 8, 1994 | [JP] | Japan | 6-37006 |

[51] Int. Cl.[6] ..... B41M 3/12

[52] U.S. Cl. ..... 428/537.5; 427/180; 428/195; 428/206; 428/211

[58] Field of Search ..... 428/195, 211, 428/323, 537.5; 347/105

[56] References Cited

U.S. PATENT DOCUMENTS

| | | | |
|---|---|---|---|
| 4,542,059 | 9/1985 | Toganoh et al. | 428/141 |
| 4,636,410 | 1/1987 | Akiya et al. | 427/261 |
| 4,636,805 | 1/1987 | Toganoh et al. | 346/1.1 |
| 4,664,952 | 5/1987 | Arai et al. | 427/256 |
| 4,686,118 | 8/1987 | Arai et al. | 427/261 |
| 4,758,461 | 7/1988 | Akiya et al. | 428/212 |
| 4,785,313 | 11/1988 | Higuma et al. | 346/135.1 |
| 4,832,984 | 5/1989 | Hasegawa et al. | 427/161 |
| 4,877,680 | 10/1989 | Sakaki et al. | 428/332 |
| 4,923,515 | 5/1990 | Koike et al. | 106/22 |
| 4,956,223 | 9/1990 | Arai et al. | 428/212 |
| 4,965,612 | 10/1990 | Sakaki et al. | 346/1.1 |
| 5,041,328 | 8/1991 | Akiya et al. | 428/212 |
| 5,081,470 | 1/1992 | Kurabayashi et al. | 346/1.1 |
| 5,099,255 | 3/1992 | Koike et al. | 346/1.1 |
| 5,101,218 | 3/1992 | Sakaki et al. | 346/1.1 |
| 5,124,201 | 6/1992 | Kurabayashi et al. | 428/323 |
| 5,137,778 | 8/1992 | Nakatsugawa et al. | 428/330 |
| 5,182,175 | 1/1993 | Sakaki et al. | 428/537.5 |
| 5,246,774 | 9/1993 | Sakaki et al. | 428/323 |
| 5,277,962 | 1/1994 | Nakatsugawa et al. | 428/206 |
| 5,362,558 | 11/1994 | Sakaki et al. | 428/323 |
| 5,570,120 | 10/1996 | Sakaki et al. | 347/105 |
| 5,590,145 | 12/1996 | Nitta | 372/50 |

FOREIGN PATENT DOCUMENTS

| | | | |
|---|---|---|---|
| 0317046 | 5/1989 | European Pat. Off. | 428/195 |
| 0411638 | 2/1991 | European Pat. Off. | 428/195 |
| 0495591 | 7/1992 | European Pat. Off. | 428/195 |
| 3330420 | 2/1984 | Germany | 428/195 |
| 3626567 | 2/1987 | Germany | 428/195 |
| 51-13244 | 2/1976 | Japan | 428/195 |
| 54-59936 | 5/1979 | Japan | 428/195 |
| 59-35977 | 2/1984 | Japan | 428/195 |
| 59-162561 | 9/1984 | Japan | 428/195 |
| 59-191068 | 10/1984 | Japan | 428/195 |
| 1-135682 | 5/1989 | Japan | 428/195 |

*Primary Examiner*—Bruce H. Hess

*Attorney, Agent, or Firm*—Fitzpatrick, Cella, Harper & Scinto

[57] ABSTRACT

A recording paper comprising pulp fibers and a filler has a surface where pulp fibers bared to the surface and pulp fibers covered with particles are present together in portions. The quantity of ink transfer at a minimum ink-shoot time interval for adjacent dots with different colors as measured by Bristow's test method is not smaller than a maximum shot-in ink quantity per unit area of recording system used.

3 Claims, 9 Drawing Sheets

○ : QUANTITY OF INK TRANSFER AT MINIMUM INK-SHOOT TIME INTERVAL $T_1$ FOR ADJACENT DOTS

○ : QUANTITY OF INK TRANSFER AT MINIMUM INK-SHOOT TIME INTERVAL $T_1$ FOR ADJACENT DOTS

○ : QUANTITY OF INK TRANSFER AT MINIMUM INK-SHOOT TIME INTERVAL $T_1$ FOR ADJACENT DOTS

| RECORDING PAPER | $Ka_1$ | $Ka_2$ | CHANGE POINT Th |
|---|---|---|---|
| F | ≦5 | —— | —— |
| G | ≦5 | $5 < Ka_2 \leqq 15$ | $> T_1$ |
| H | ≦5 | >15 | $< T_1$ |
| I | >5 | >15 | $< T_1$ |
| J | >5 | $5 < Ka_2 \leqq 15$ | $< T_1$ |
| K | ≦5 | $5 < Ka_2 \leqq 15$ | $< T_1$ |

RECORDING PAPER, INK-JET RECORDING PROCESS AND RECORDING SYSTEM MAKING USE OF THE RECORDING PAPER

This application is a division of application Ser. No. 08/398,764, filed Mar. 6, 1995, now U.S. Pat. No. 5,591,514.

BACKGROUND OF THE INVENTION

1. Field of the Invention

This invention relates to a recording paper, in particular, a recording paper useful for color recording carried out by ink-jet recording, and an ink-jet recording process and recording system making use of such a recording paper.

2. Related Background Art

Ink-jet recording has attracted notice because of its readiness for the achievement of high-speed recording, color recording and high-density recording, and recording apparatuses making use of the ink-jet recording have come into wide use. In such ink-jet recording, exclusive coated paper is used, as disclosed, for example, in Japanese Patent Application Laid-open Nos. 59-35977 and 1-135682. The exclusive coated paper comprises base paper whose surface is completely coated with a pigment. The coated paper is suited for forming highly minute and sharp images but has the following problems.

1) It lacks the handling properties of plain paper (e.g., PPC paper and general-purpose woodfree paper).
2) It has a poor writability with pencils.
3) It may cause paper dust due to fall of coat layers.
4) It has no general-purpose properties (i.e., can not be used for other recording processes).
5) It requires a higher production cost than plain paper.

Herein, the plain paper refers to PPC paper, general-purpose woodfree paper, etc. Examples of plain paper may include toner transfer paper (PPC paper) for electrophotographic recording, nowadays widely used in offices, as disclosed in Japanese Patent Application Laid-open Nos. 51-13244, 59-162561 and 59-191068.

As in the plain paper typified by such transfer paper, conventional recording paper whose pulp fibers are entirely bare to the paper surface has the following problems.

1) It has so poor an ink absorption that the ink may slowly dry and fix when the ink is imparted in a large quantity. If something touches the recording surface in the state the ink is undried and unfixed, images are damaged.
2) Ink runs along fibers of paper when it is absorbed into the paper layer, and hence dots may become too large, or dots may have roughly irregular, or blurred outlines. Hence, no clear letters or characters and images can be obtained.
3) In an attempt to obtain color images, no satisfactory images can be obtained since inks with a plurality of colors are superimposed one after another before they fix to paper and hence the colors are blurred or non-uniformly mixed with one another at the boundaries of images with different colors (hereinafter, this phenomenon is called "bleeding").
4) Since water-soluble recording agents are used, the recorded images can have no satisfactory water fastness.
5) Coloring materials can exhibit no satisfactory color forming performance.

SUMMARY OF THE INVENTION

Accordingly, an object of the present invention is to provide a recording paper having good properties such as image quality, image density and water fastness required for, in particular, full-color ink-jet recording paper and inherent in conventional exclusive coated paper and also having solved the problems discussed above, and to provide an ink-jet recording process and recording system making use of such a recording paper.

Another object of the present invention is to provide a recording paper that can be used also in electrophotographic recording, thermal transfer recording and impact recording and also can be used as writing paper writable with pencils, marking pens, ball point pens or the like.

The above objects can be achieved by the invention described below.

In a first embodiment, the present invention is a recording paper comprising pulp fibers and a filler, i) having a surface where pulp fibers bared to the surface and pulp fibers covered with particles are present together in portions, and ii) wherein the quantity of ink transfer at a minimum ink-shoot time interval for adjacent dots with different colors as measured by the Bristow's test method is not smaller than a maximum shot-in ink quantity per unit area of a recording system used.

In the first embodiment, the present invention is also an ink-jet recording process comprising imparting ink droplets to a recording paper to make a record, wherein the recording paper comprises pulp fibers and a filler, i) having a surface where pulp fibers bared to the surface and pulp fibers covered with particles are present together in portions, and ii) wherein the quantity of ink transfer at a minimum ink-shoot time interval for adjacent dots with different colors as measured by the Bristow's test method is not smaller than a maximum shot-in ink quantity per unit area of a recording system used.

In the first embodiment, the present invention is still also a recording system comprising an ink-jet recording apparatus and a recording paper used therein, wherein the recording paper comprises pulp fibers and a filler, i) having a surface where pulp fibers bared to the surface and pulp fibers covered with particles are present together in portions, and ii) wherein the quantity of ink transfer at a minimum ink-shoot time interval for adjacent dots with different colors as measured by the Bristow's test method is not smaller than a maximum shot-in ink quantity per unit area of a recording system used.

In a second embodiment, the present invention is a recording paper comprising a base paper mainly composed of pulp fibers and a filler, i) coated with a coating solution containing particles, to have a surface where pulp fibers bared to the surface and pulp fibers covered with particles are present together in portions, and ii) wherein the base paper has a coefficient of absorption $K\alpha$ of not less than 10 $ml/(m^2 \cdot msec^{1/2})$ at a contact time of not longer than 4 msec as measured by the Bristow's test method using an ink having a surface tension of from 45 to 50 dyne/cm at 25° C.

In the second embodiment, the present invention is also a process for producing a recording paper, comprising the step of applying to a base paper mainly composed of pulp fibers and a filler a coating solution containing particles, to produce a recording paper having a surface where pulp fibers bared to the surface and pulp fibers covered with particles are present together in portions; the base paper having a coefficient of absorption $K\alpha$ of not less than 10 $ml/(m^2 \cdot msec^{1/12})$ at a contact time of not longer than 4 msec as measured by the Bristow's test method using an ink having a surface tension of from 45 to 50 dyne/cm at 25° C.

In a third embodiment, the present invention is a recording paper comprising pulp fibers and a filler, i) having a surface where pulp fibers bared to the surface and pulp fibers covered with particles are present together in portions, and ii) wherein the paper has two kinds of coefficient of absorption $Ka_1$ ($t_1<T_h$) and $Ka_2$ ($t_2>T_h$) when tested by the Bristow's method, where a change point Th at which $Ka_1$ changes to $Ka_2$ is present at a time shorter than a minimum ink-shoot time interval T1 for adjacent dots with different colors and $Ka_1$ and $Ka_2$ satisfy the following condition.

$Ka_1 \leqq 5.0$ $5.0 < Ka_2 \leqq 15.0$

DESCRIPTION OF THE PREFERRED EMBODIMENTS

First Embodiment

Figure 1:
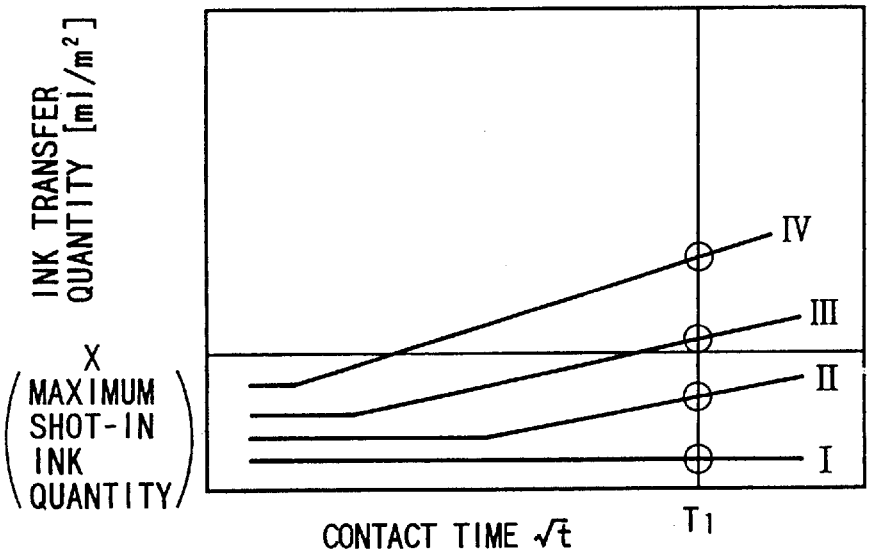
FIG. 1 shows Bristow's test results showing a feature of the first embodiment of the present invention.

A first feature of the recording paper according to the first embodiment of the present invention is that the recording paper is mainly composed of pulp fibers and a filler and has a surface where pulp fibers bared to the surface and pulp fibers covered with particles are present together in portions.

The recording paper may preferably have a surface where, within the range of 1 $mm^2$ of the surface, at least one pulp fiber recognizable as a fiber of 100 $\mu$m or longer is seen and also some pulp fibers covered with particles and not recognizable as having the shape of fibers are present.

A second feature of the recording paper according to the first embodiment of the present invention is that the quantity of ink transfer at a minimum ink-shoot time interval for adjacent dots with different colors as measured by the Bristow's test method is not smaller than a maximum shot-in ink quantity per unit area of a recording system used.

The Bristow's test method is a test method as prescribed by Japan Technical Association of the Pulp and Paper Industry (J' TAPPI), and its details are described in J' TAPPI No. 51, Test Method for Liquid Absorption of Paper and Paperboard.

The Bristow's test method is carried out using the ink of a recording system used. When an ink with a high surface tension and an ink with a low surface tension are used in the recording system used, the measurement is made using the ink with a high surface tension. In the Bristow's test, a head box slit width is also adjusted in accordance with the surface tension of the ink.

In this embodiment, what is meant by the minimum ink-shoot time interval for adjacent dots is a time interval which is shortest among time intervals at which ink droplets with different colors are imparted to adjacent picture elements, when a printing time per unit area of 100% duty is set using a mode which is shortest among printing modes of the recording system used. For example, when in a certain recording system a mode whose printing time per unit area of 100% duty is shortest is used and there are differences between a time interval T1 for imparting A-color and B-color to adjacent picture elements, a time interval T2 for imparting A-color and C-color (T2>T1) and a time interval T3 for imparting A-color and D-color (T3>T2>T1), it refers to the shortest time T1.

The maximum shot-in ink quantity refers to a maximum shot-in ink quantity per unit area. For example, when a maximum value of shot-in ink quantity per picture element is M picoliter (pl) and the resolution is N dpi, the maximum shot-in ink quantity is $M \times N^2$ pl/$inch^2$. When the shot-in ink quantities differ depending on colors of inks, the largest shot-in ink quantity is regarded as the maximum shot-in ink quantity.

The present inventors have discovered that the ink-jet recording suitability correlates with Bristow's test results on paper.

The recording paper satisfying the above values has good fixing properties, and can decrease the bleeding that may occur at the boundaries where solid dots formed of inks with different colors are adjacent to one another, especially when used in full-color ink-jet recording, and also can decrease the bleeding when an ink with a high surface tension and an ink with a low surface tension are used in combination.

If the quantity of ink transfer is smaller than the maximum shot-in ink quantity, the ink having adhered to the surface is not well absorbed into the paper and hence the paper may have poor fixing properties. Especially when used in full-color ink-jet recording, the bleeding may occur, and hence such a paper is not suitable for full-color ink-jet recording.

FIG. 1 shows results of measurement by the Bristow's test method. The measurement is made using an ink in the recording system used. The Bristow's test method determines the quantity of transfer of liquid per unit area (v:ml/$m^2$) with respect to liquid-to-paper contact time raised to ½nd power [$\sqrt{t}$($sec^{1/2}$)]. As stated above, the recording paper has a poor ink absorption and has no good fixing properties and bleeding-free properties, when recording paper I or II in which the quantity of ink transfer at the minimum ink-shoot time interval T1 for adjacent dots does not reach the maximum shot-in ink quantity X ml/$m^2$ is used. On the other hand, the recording paper has a good ink absorption and has good fixing properties and bleeding-free properties to make it possible to obtain highly colorful images, when recording paper III or IV in which the quantity of ink transfer at the minimum ink-shoot time interval T1 for adjacent dots reaches the maximum shot-in ink quantity X ml/$m^2$ is used.

Figure 2:
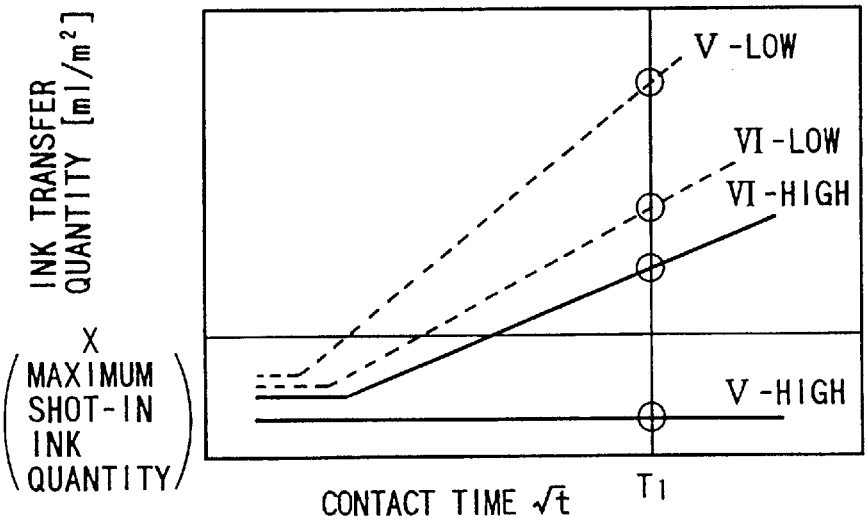
FIG. 2 shows Bristow's test results showing a feature of the first embodiment of the present invention.

FIG. 2 shows results of Bristow's tests made on like recording paper using an ink with a high surface tension and an ink with a low surface tension. V-high and V-low make use of like recording paper V, and the V-high and the V-low show the results of measurement using the ink with a high surface tension and the ink with a low surface tension, respectively. VI-high and VI-low also similarly make use of like recording paper VI, and show the results of measurement using the ink with a high surface tension and the ink with a low surface tension, respectively.

In the recording paper V, the quantity of ink transfer at the minimum ink-shoot time interval T1 for adjacent dots reaches the maximum shot-in ink quantity X ml/m$^2$ when the ink with a low surface tension is used, but does not reach the maximum shot-in ink quantity X ml/m$^2$ when the ink with a high surface tension is used. The use of the ink with a high surface tension in such a recording paper results in a poor ink absorption and no good fixing properties and bleeding-free properties. On the other hand, as in the recording paper VI, the recording paper in which the quantity of ink transfer at the minimum ink-shoot time interval T1 for adjacent dots reaches the maximum shot-in ink quantity X ml/m$^2$ when either the ink with a high surface tension or the ink with a low surface tension is used, has a good ink absorption for both the inks and can obtain highly colorful images with good fixing properties and bleeding-free properties.

Thus, when the ink with a high surface tension or the ink with a low surface tension is used in the recording system used, highly colorful images well fixed and free of bleeding can be obtained so long as the quantity of ink transfer at the minimum ink-shoot time interval T1 for adjacent dots reaches the maximum shot-in ink quantity X ml/m$^2$.

The recording paper of the present invention is also preferable in a system where the ink with a high surface tension and the ink with a low surface tension are used in combination. Recording on the recording paper of the present invention, using an ink with a high surface tension (45 to 60 dyne/cm) as black ink and using inks with a low surface tension (25 to 35 dyne/cm) as yellow, magenta and cyan inks, makes it possible to obtain images having a good quality level of black characters and causing no boundary bleeding between black ink dots and color ink dots and between color ink dots.

Second Embodiment

A first feature of the recording paper according to the second embodiment of the present invention is that the recording paper is mainly composed of pulp fibers and a filler and has a surface where pulp fibers bared to the surface and pulp fibers covered with particles are present together in portions.

The recording paper may preferably have a surface where, within the range of 1 mm$^2$ of the surface, at least one pulp fiber recognizable as a fiber of 100 $\mu$m or longer is seen and also some pulp fibers covered with particles and not recognizable as having the shape of fibers are present.

A second feature of the second embodiment of the present invention is that the base paper constituting the recording paper of the present invention has a coefficient of absorption $K\alpha$ [ml/(m$^2$·msec$^{1/2}$)] of not less than 10 at a contact time of not longer than 4 msec as measured by the Bristow's test method using an ink having a surface tension of 45 to 50 dyne/cm at 25° C.

The contact time 4 msec is a value obtained by comparing the relation between Bristow's test results and the ink-jet recording suitability. The ink used in the Bristow's test has a surface tension that is maximum in those of usual inks for ink-jet recording. The reason why an ink with a high surface tension is used is that the ink with a high surface tension has less tendency to be absorbed in paper than the ink with a low surface tension and hence may seriously cause bleeding.

If a base paper not satisfying the above value is used, it is difficult to obtain a recording paper having an ink-jet recording suitability even if materials to be coated on the base paper surface are changed.

The recording paper made using a base paper satisfying the above values has good fixing properties and can well prevent the bleeding that may occur at the boundaries where solid dots of inks with different colors are adjoining to one another, especially when used in full-color ink-jet recording. The recording paper of the present embodiment is also preferable in a system where the ink with a high surface tension and the ink with a low surface tension are used in combination. Recording on the recording paper of the present embodiment, using an ink with a high surface tension (45 to 60 dyne/cm) as black ink and using inks with a low surf ace tension (25 to 35 dyne/cm) as yellow, magenta and cyan inks, makes it possible to obtain images having a good quality level of black characters and causing no boundary bleeding between black ink dots and color ink dots and between color ink dots.

A third feature of the second embodiment of the present invention is that the quantity of ink transfer at a minimum ink-shoot time interval for adjacent dots with different colors as measured by the Bristow's test method is not smaller than a maximum shot-in ink quantity per unit area of a recording system used.

The present inventors have discovered that the ink-jet recording suitability correlates with Bristow's test results on paper.

If the quantity of ink transfer is smaller than the maximum shot-in ink quantity, the ink having adhered to the surface is not well absorbed in paper and hence the paper may have poor fixing properties. Especially when used in full-color ink-jet recording, the bleeding may occur, and hence such a paper is not suitable for full-color ink-jet recording.

Figure 5:
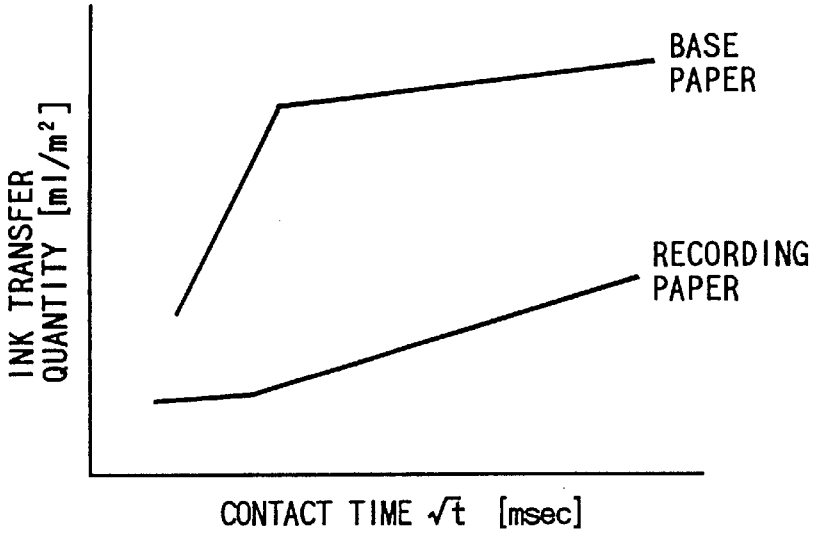
FIG. 5 shows Bristow's test results showing a feature of the second embodiment of the present invention.
Figure 7:
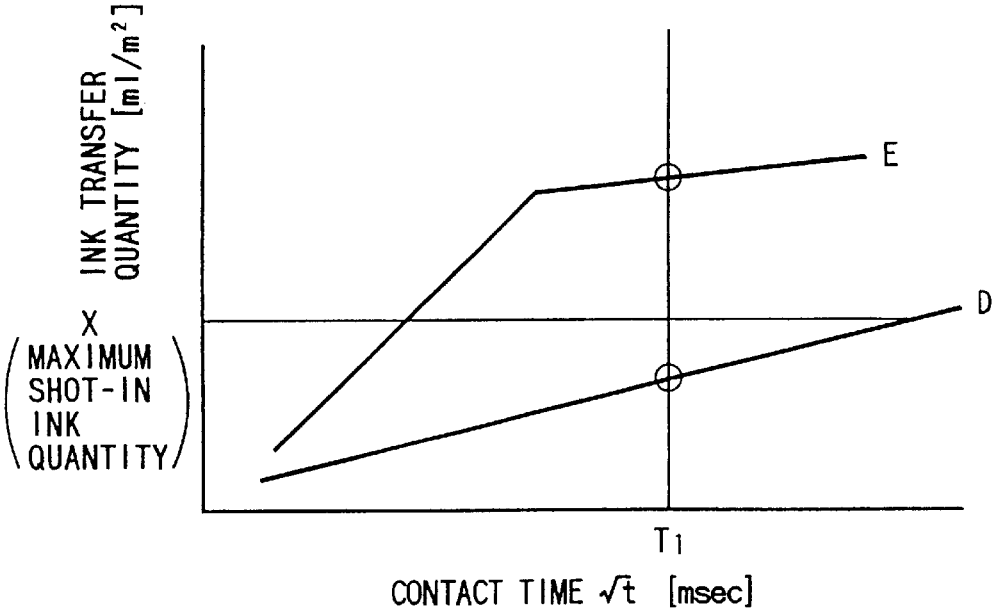
FIG. 7 shows Bristow's test results according to the second embodiment of the present invention.
Figure 6:
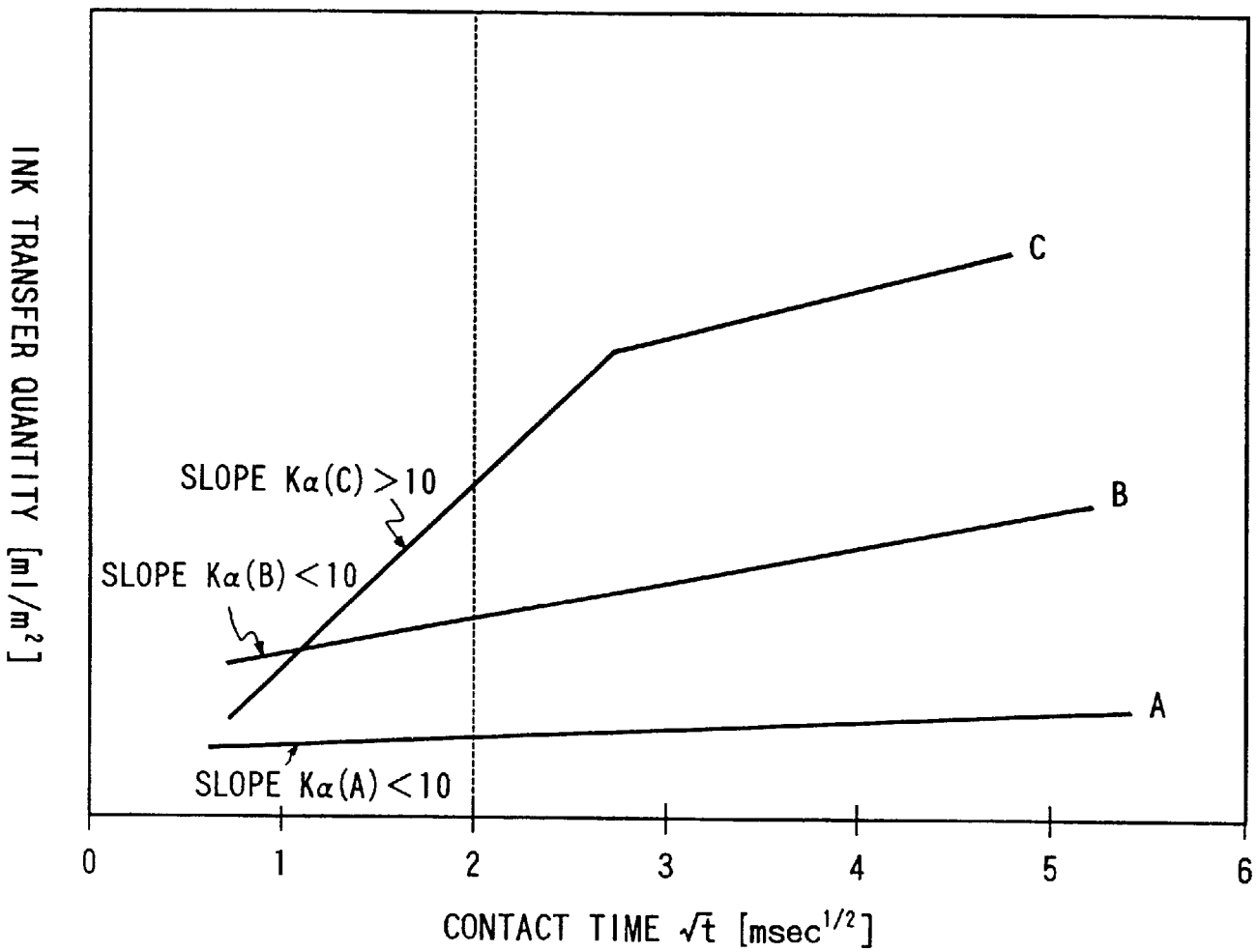
FIG. 6 shows Bristow's test results according to the second embodiment of the present invention.

FIGS. 5, 6 and 7 show results of measurement by the Bristow's test method. The measurement is made using an ink with a surface tension of 45 to 50 dyne/cm. The Bristow's test method determines the quantity of transfer of liquid per unit area (v:ml/m$^2$) with respect to liquid-to-paper contact time raised to ½nd power [$\sqrt{t}$(sec$^{1/2}$)]. The coefficient of absorption $K\alpha$ is indicated by the slope of a graph.

As shown in FIG. 5, the absorption of the recording paper having the surface configuration described above is lower than that of the base paper, and hence the ink-jet recording suitability can not be improved even if materials to be coated on the surface are changed, unless the base paper satisfies the above condition.

Thus, as in base paper A or B shown in FIG. 6, no recording paper having an ink-jet recording suitability can be obtained when a base paper having the coefficient of absorption $K\alpha$ is less than 10 at a contact time of not longer than 4 msec. The base paper used in the recording paper of the present embodiment must have the coefficient of absorption $K\alpha \geqq 10$ at a contact time of not longer than 4 msec.

In addition, as in recording paper D shown in FIG. 7, a recording paper D' making use of base paper D in which the quantity of ink transfer at the minimum ink-shoot time interval T1 for adjacent dots does not reach the maximum shot-in ink quantity X ml/m$^2$ are used has a poor ink absorption and has no good fixing properties and bleeding-free properties. On the other hand, a recording paper E' making use of base paper E in which the quantity of ink transfer at the minimum ink-shoot time interval T1 for adjacent dots reaches the maximum shot-in ink quantity X $ml/m^2$ is used has a good ink absorption and has good fixing properties and bleeding-free properties to make it possible to obtain highly colorful images also in a recording system in which the ink with a high surface tension and the ink with a low surface tension are used in combination.

Third Embodiment

A first feature of the recording paper according to the third embodiment of the present invention is that the recording paper is mainly composed of pulp fibers and a filler and has a surface where pulp fibers bared to the surface and pulp fibers covered with particles are present together in portions.

The recording paper may preferably have a surface where, within the range of 1 $mm^2$ of the surface, at least one pulp fiber recognizable as a fiber of 100 $\mu$m or longer is seen and also some pulp fibers covered with particles and not recognizable as having the shape of fibers are present.

A second feature of the recording paper according to the second embodiment of the present invention is that the paper has two kinds of coefficient of absorption $Ka_1$ ($t_1<T_h$) and $Ka_2$ ($t_1>T_h$) when tested by the Bristow's method, where a change point Th at which $Ka_1$ changes to $Ka_2$ is present at a time shorter than a minimum ink-shoot time interval T1 for adjacent dots with different colors and $Ka_1$ and $Ka_2$ satisfy the condition of $Ka_1 \leqq 5.0$ and $5.0<Ka_2 \leqq 15.0$ The measurement by the Bristow's test method is made using an ink of the recording system used.

Figure 9:
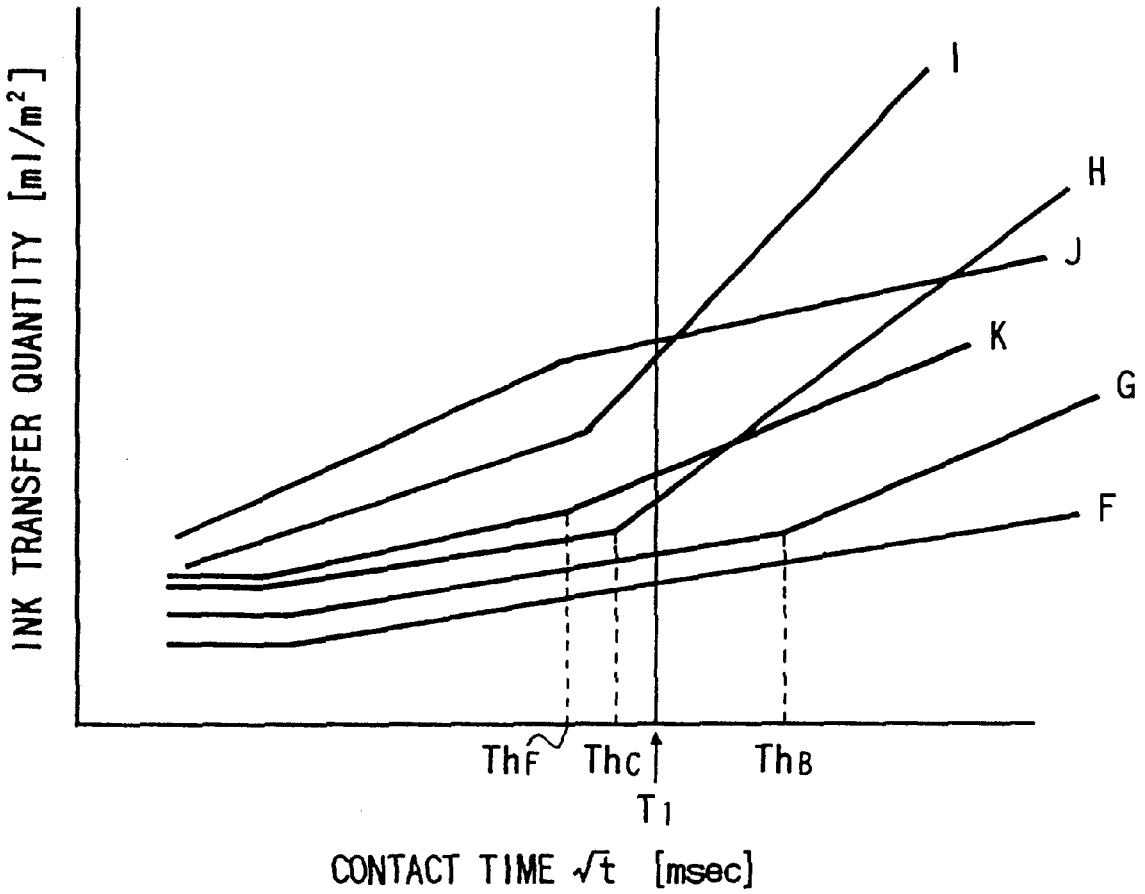
FIG. 9 shows Bristow's test results on a recording paper according to the third embodiment of the present invention.

FIG. 9 shows results of measurement by the Bristow's test method.

Recording paper F has $Ka_1 \leqq 5.0$, has a small percent of ink run and shows a good character quality level. It, however, has no change point Th, and hence has a low ink absorption rate, causes serious bleeding, is unsuitable especially for full-color images, and can not provide solid areas made completely full, resulting in a low image density.

Recording paper G has $Ka_1 \leqq 5.0$ and also $5.0<Ka_2 \leqq 15.0$, and hence has a small percent of ink run and shows a good character quality level. The satisfaction of the condition $Ka_2$ also results in a high image density. It, however, has the change point Th but $Th \geqq T1$ (minimum ink-shoot time interval for adjacent dots with different colors), and hence the recording paper has a poor ink absorption and tends to cause bleeding.

Recording paper H has $Ka_1 \leqq 5.0$ and $Th < T1$, and hence has a small percent of ink run and shows a good character quality level. It, however, has $Ka_2<15.0$, and hence has so good an ink absorption that the ink may strike through the back of the paper, resulting in a low image density.

Recording paper I has $T_h<T1$, $Ka_1>5.0$ and $Ka_2>15.0$, and hence causes no bleeding, but has a large percent of ink run, causes dot gain, and shows a poor character quality level and a low image density.

Recording paper J has $T_h<T1$ and $0<Ka_2 \leqq 15\ 0$, and hence causes no bleeding while giving a high image density, but has a large percent of ink run, causes dot gain and shows a poor character quality level because of $Ka_1>5.0$.

Recording paper K satisfies the above conditions, and the use of such a recording paper makes it possible to achieve a small percent of ink run, and to obtain images with a good character quality level, a good fixing performance, no bleeding, a high image density and a high minuteness.

The present invention will be described below in greater detail with respect to the first to third embodiments described above.

The recording base paper used in the present invention is mainly composed of chemical pulp as typified by LBKP and NBKP, a sizing agent and a filler, as well as other paper making auxiliaries optionally used, and is made by conventional methods. As pulp materials used, mechanical pulp and waste paper regenerated pulp may be used in combination, or any of them may be used as a main component.

The sizing agent may include rosin sizes, alkylketene dimers, alkenyl succinic anhydrides, petroleum resin sizes, epichlorohydrin and acrylamide. The filler may include calcium carbonate, kaolin, talc and titanium dioxide. In the present invention, examples thereof are by no means limited to these.

As a surface coat material, it may include casein, starch, cellulose derivatives such as carboxymethyl cellulose and hydroxymethyl cellulose; hydrophilic resins having a swellability to ink, as exemplified by polyvinyl alcohol, polyvinyl pyrrolidone, sodium polyacrylate and polyacrylamide; resins having hydrophilic part and hydrophobic part in the molecule, as exemplified by SBR latex, acrylic emulsion and a styrene/acrylic acid copolymer; substances having a water repellency, as exemplified by silicone oils, paraffin waxes and fluorine compounds; and the sizing agents set forth above.

Inorganic pigments or organic pigments hitherto commonly used may also be used in combination. Examples of the inorganic pigments can be silica, alumina, aluminum silicate, magnesium silicate, hydrotalcite, titanium oxide, clay and talc. Examples are by no means limited to these. Examples of the organic pigment can be plastic pigments such as urea resins, urea-formalin resins, polyethylene resins and polystyrene resins. Examples are by no means limited to these.

Any of these materials may be imparted to the recording surface in an amount of about 0.1 to 5 $g/m^2$.

To prepare the recording paper of the present invention, a water-based coating solution containing the pigment, resin and other additives as described above may be applied to the surface of the base paper by known processes as exemplified by roll coating, blade coating, air-knife coating, gate roll coating, size pressing and Simu Sizer Process. Thereafter, the coating is dried using, e.g., a hot air drying furnace or a hot drum. Thus, the recording paper of the present invention can be obtained. In order to further smoothen the surface or increase the surface strength, super calendering may be applied.

Using the materials as described above, the recording paper having the surface configuration characteristic of the present invention is prepared.

The recording paper of the present invention is prepared so as to have a water extraction pH of 6 or more, and preferably 7 or more. The water extraction pH is a value obtained by measuring, according to JIS z-8802, the pH of an extract formed when about 1.0 g of a test piece is immersed in 70 ml of distilled water as prescribed in JIS P-8133. If the pH is less than the above range, a problem may arise in view of the long-term storage stability of the paper itself, and dyes may exhibit no satisfactory color forming performance on the paper surface.

With regard to stöckigt sizing degree of the recording paper thus prepared, inks can never be absorbed in paper if it is too high, and hence the fixing performance and drying performance of inks having adhered tend to become poor. Thus, the stöckigt sizing degree may preferably be in the range of from 0 to 40 seconds.

With regard to the inks themselves used when the ink-jet recording is carried out on the recording paper described above, known inks can be used without any problems. As coloring materials for the inks, it is possible to use water-soluble dyes as typified by direct dyes, acid dyes, basic dyes, reactive dyes and food dyes, which can be used without any particular limitations so long as they are those used in usual ink-jet recording.

However, as a particularly preferred embodiment in the ink-jet recording process of the present invention, it is an ink-jet recording process making use of inks containing a direct dye and/or an acid dye as a recording agent or agents. In conventional inks, such water-soluble dyes are commonly used in such a proportion that they comprise about 0.1 to 10% by weight, and may be in a like proportion also in the present invention.

Solvents used in water-based inks used in the present invention may comprise water or a mixed solvent of water and a water-soluble organic solvent, and particularly preferably a mixed solvent of water and a water-soluble solvent, containing as the water-soluble organic solvent a polyhydric alcohol having an ink drying preventive effect.

An ink-jet recording method will be described below. The ink-jet recording process of the present invention can be applied to any conventionally known ink-jet recording methods which carry out recording by ejecting ink droplets from nozzles, utilizing various types of drive mechanisms. As typical examples thereof, they include the method disclosed in Japanese Patent Application Laid-open No. 54-59936, i.e., an ink-jet recording method in which an ink having undergone the action of heat energy causes an abrupt change in volume and the ink is ejected from a nozzle by the force of action attributable to this change in state.

Figure 10:
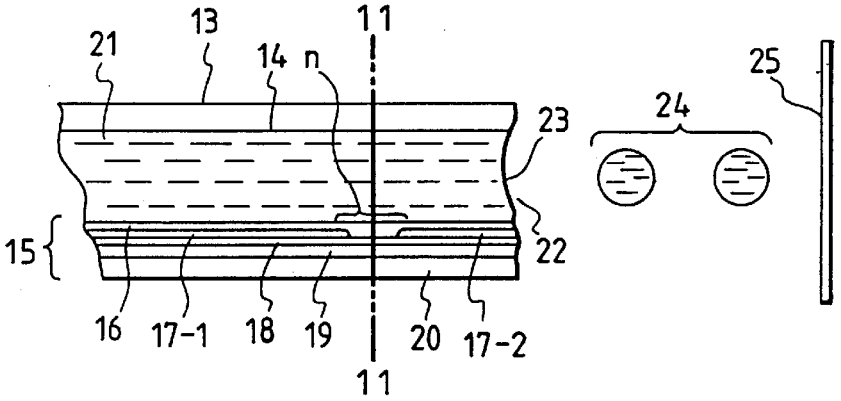
FIG. 10 is a cross-section of an ink-jet recording head used in the present invention.
Figure 11:
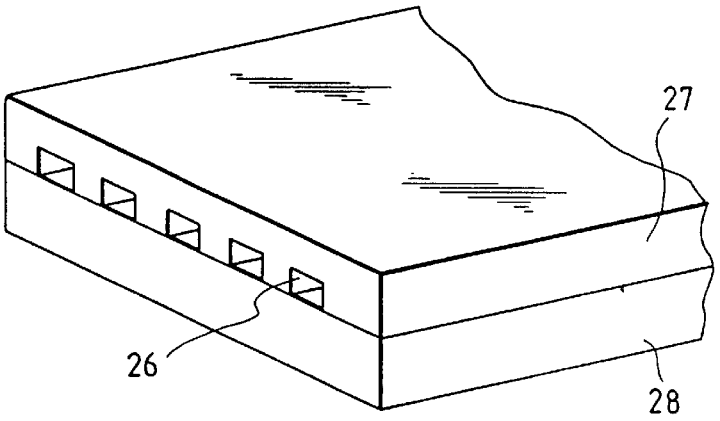
FIG. 11 is a cross-section of an ink-jet recording head used in the present invention.
Figure 12:
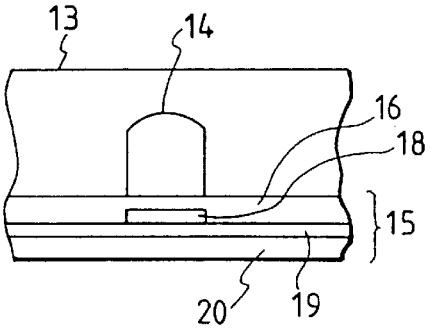
FIG. 12 is a perspective appearance of a multiple head comprised of the head shown in FIGS. 10 and 11.

An example of the ink-jet recording apparatus preferable in the ink-jet recording process of the present invention will be described below. FIGS. 10, 11 and 12 show examples of the construction of the recording head, which is a main component of the apparatus.

A head 13 is formed by bonding a glass, ceramic or plastic plate or the like provided with an ink flow path 14, to a heating head 15 having a heating resistor used in thermal recording (the drawing shows a head, to which, however, the invention is not limited). The heating head 15 is comprised of a protective film 16 formed of silicon oxide or the like, aluminum electrodes 17-1 and 17-2, a heating resistor layer 18 formed of nichrome or the like, a heat accumulating layer 19, and a substrate 20 with good heat dissipation properties, made of alumina or the like.

The ink 21 reaches an ejection orifice (minute opening) 22 and a meniscus 23 is formed there by a pressure P.

Now, upon application of electric signals to the electrodes 17-1 and 17-2, heat is abruptly generated at the region denoted by n in the thermal head 15, so that bubbles are generated in the ink 21 coming into contact with this region. The pressure thus produced thrusts out the meniscus 23 and the ink is ejected from the orifice 22 in the form of recording minute drops 24 to fly against a recording medium 25. FIG. 12 schematically illustrates a multi-head comprising the head as shown in FIG. 10 arranged in a large number. This multi-head is prepared by closely bonding a glass plate 27 having multiple grooves 26, to a heating head 28 similar to the head as illustrated in FIG. 10.

FIG. 10 is a cross-sectional view of the head 13 along its ink flow path, and FIG. 11 is a cross-sectional view along the line 11—11 in FIG. 10.

Figure 13:
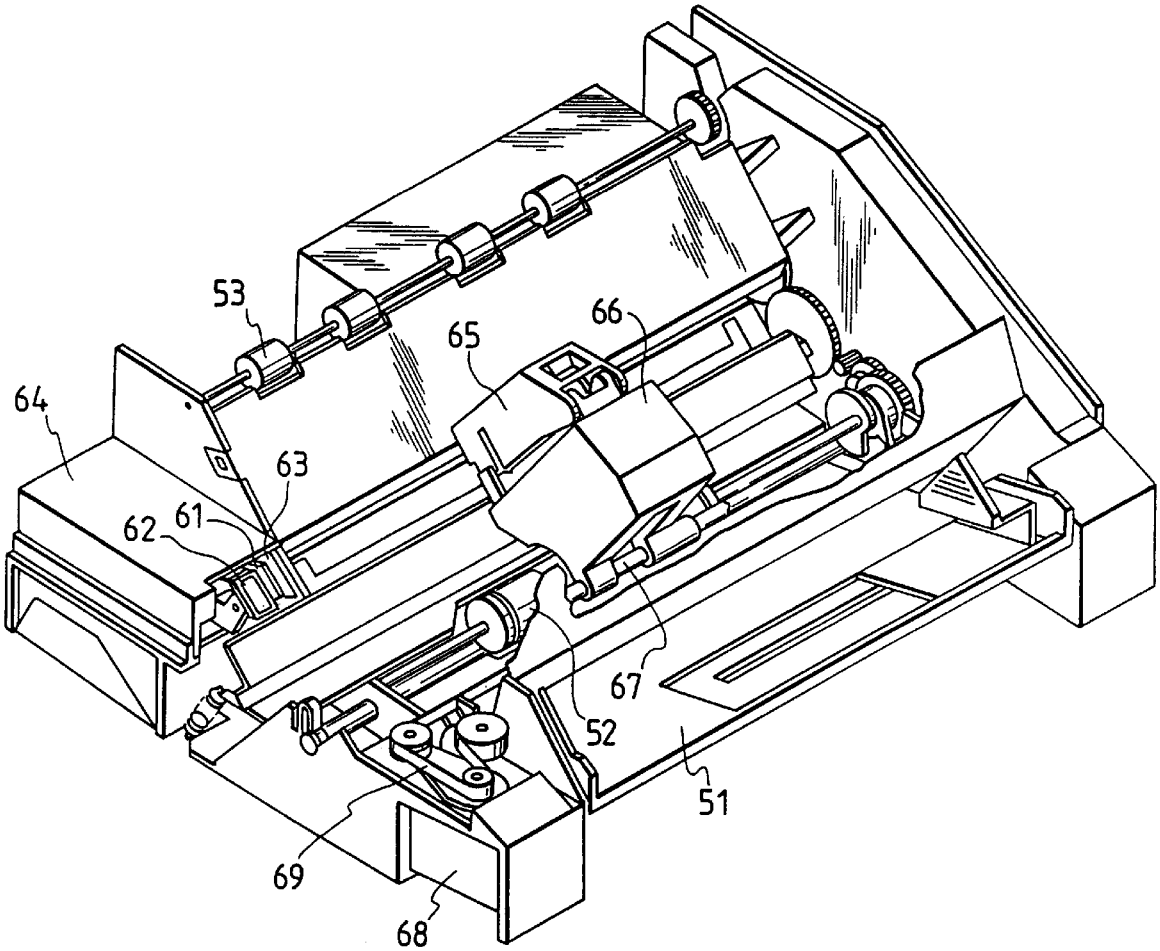
FIG. 13 is a perspective view showing an example of an ink-jet recording apparatus.

FIG. 13 shows an example of the ink-jet recording apparatus in which such a head has been incorporated. In FIG. 13, reference numeral 61 denotes a blade serving as a wiping member in the form of a cantilever, one end of which is a stationary end retained by a blade-retaining member. The blade 61 is provided at the position adjacent to the region in which a recording head makes a record. In the present example, the blade is retained in such a form that it projects to the course through which the recording head is moved. Reference numeral 62 denotes a cap, which is provided at the home position adjacent to the blade 61, and is so constituted that it moves in the direction perpendicular to the direction in which the recording head is moved and comes into contact with the face of ejection openings to carry out capping. Reference numeral 63 denotes an ink absorber provided adjoiningly to the blade 61, and, similar to the blade 61, is retained in such a form that it projects to the course through which the recording head is moved.

The above blade 61, cap 62 and absorber 63 constitute an ejection restoration assembly 64, where the blade 61 and the absorber 63 remove the water, dust or the like from the ink ejection opening face.

Reference numeral 65 denotes the recording head having an ejection energy generating means and ejects ink to the recording medium set opposingly to the ejection opening face provided with ejection openings, to carry out recording. Reference numeral 66 denotes a carriage on which the recording head 65 is mounted so that the recording head 65 can be moved. The carriage 66 is slidably associated with a guide shaft 67. Part of the carriage 66 is connected (not shown) with a belt 69 driven by a motor 68. Thus, the carriage 66 can be moved along the guide 67 and hence the recording head 65 can be moved from a recording region to a region adjacent thereto.

Reference numeral 51 denotes a paper feeding part from which recording mediums are inserted, and 52, a paper feed roller driven by a motor (not shown). With such construction, the recording medium is fed to the position opposing to the ejection opening face of the recording head, and, with progress of recording, outputted from a paper output section provided with a paper output roller 53.

In the above constitution, the cap 62 of the head restoration assembly 64 is receded from the moving course of the recording head 65 when the recording head 65 is returned to its home position, e.g., after completion of recording, and the blade 61 stands projected to the moving course. As a result, the ejection opening face of the recording head 65 is wiped. When the cap 62 comes into contact with the ejection opening face of the recording head 65 to carry out capping, the cap 62 is moved in such a way that it projects to the moving course of the recording head.

When the recording head 65 is moved from its home position to the position at which recording is started, the cap 62 and the blade 61 are at the same position as the position where the ejection opening face is wiped. As a result, the ejection opening face of the recording head 65 is wiped also at the time of this movement.

The above movement of the recording head to its home position is made not only at the time of the completion of recording or restoration of ejection, but also when the recording head is moved between recording regions for the purpose of recording, during which it is moved to the home position adjacent to each recording region at given intervals, where the ejection opening face is wiped in accordance with this movement.

When adapted to multi-color recording, recording heads respectively holding black, cyan, magenta and yellow inks are arranged on the carriage 66 in parallel by four colors. In place of the recording heads arranged in parallel, a single recording head may be divided into four sections in a column. Also, in place of the four color inks, cyan, magenta and yellow, three color inks may be used.

EXAMPLES

The present invention will be described below in greater detail by giving Examples. In the following, "part(s)" is "part(s) by weight".

Examples of First Embodiment

Preparation of Recording Paper:

In a mixture obtained by beating 80 parts of LBKP and 20 parts of NBKP in 430 ml of C.S.F. as starting material pulp, 10 parts of kaolin (available from Tsuchiya Kaolin Ind., Ltd.), 0.4 part of cationized starch and 0.2 part of polyacrylamide (available from Harima Chemicals, Inc.) were mixed to make a recording base paper 1 with a basis weight of 81 g/m$^2$ by a conventional method. In the same starting material composition as the above, 0.075 part of neutral rosin sizing agent (SIZE PINE NT, available from Arakawa Chemical Industries, Ltd.) was further mixed to make a recording base paper 2 with a basis weight of 80 g/m$^2$ by a conventional method. The preparation of the recording base paper 2 was repeated to make recording base papers 3 and 4, except that the neutral rosin sizing agent was used in an amount of 0.25 part and 0.4 part, respectively.

The above recording base papers were each coated with the following coating solution by bar coating so as to have a dried coating weight of 2 g/m$^2$. Thus, recording papers 1 to 4 were prepared.

Composition of Coating Solution:

| | |
|---|---|
| Finely divided silica (MIZUKASIL P-78D, available from Mizusawa Industrial Chemicals, Ltd.) | 10 parts |
| Polyvinyl alcohol (PVA 105, available from Kuraray Co., Ltd.) | 10 parts |
| Water | 80 parts |

The surface configurations of these recording papers were observed on a scanning electron microscope to prove that pulp fibers bared to the surface and pulp fibers covered with particles were present together in portions.

Figure 3:
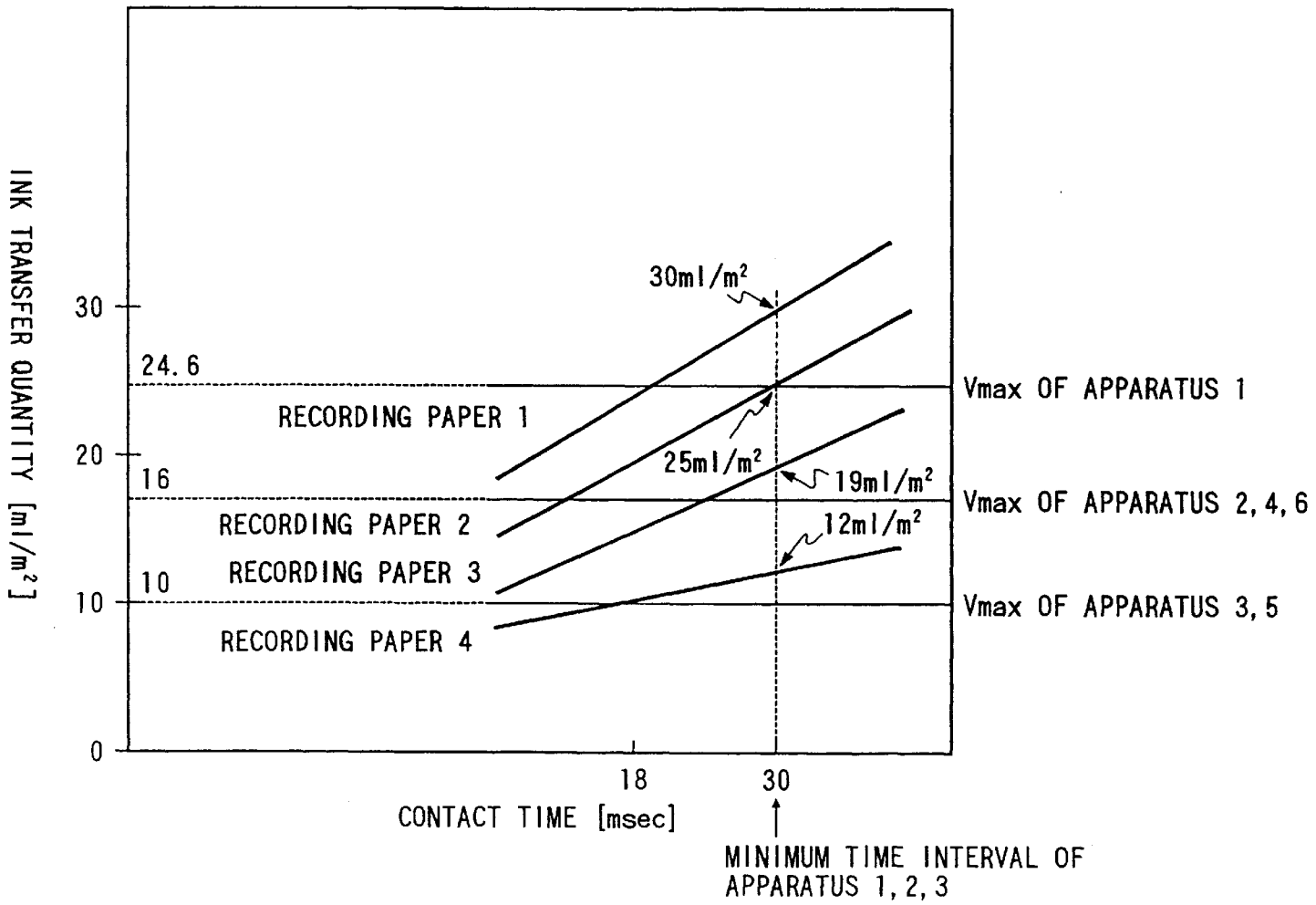
FIG. 3 shows Bristow's test results on a recording paper prepared in an Example of the first embodiment.
Figure 4:
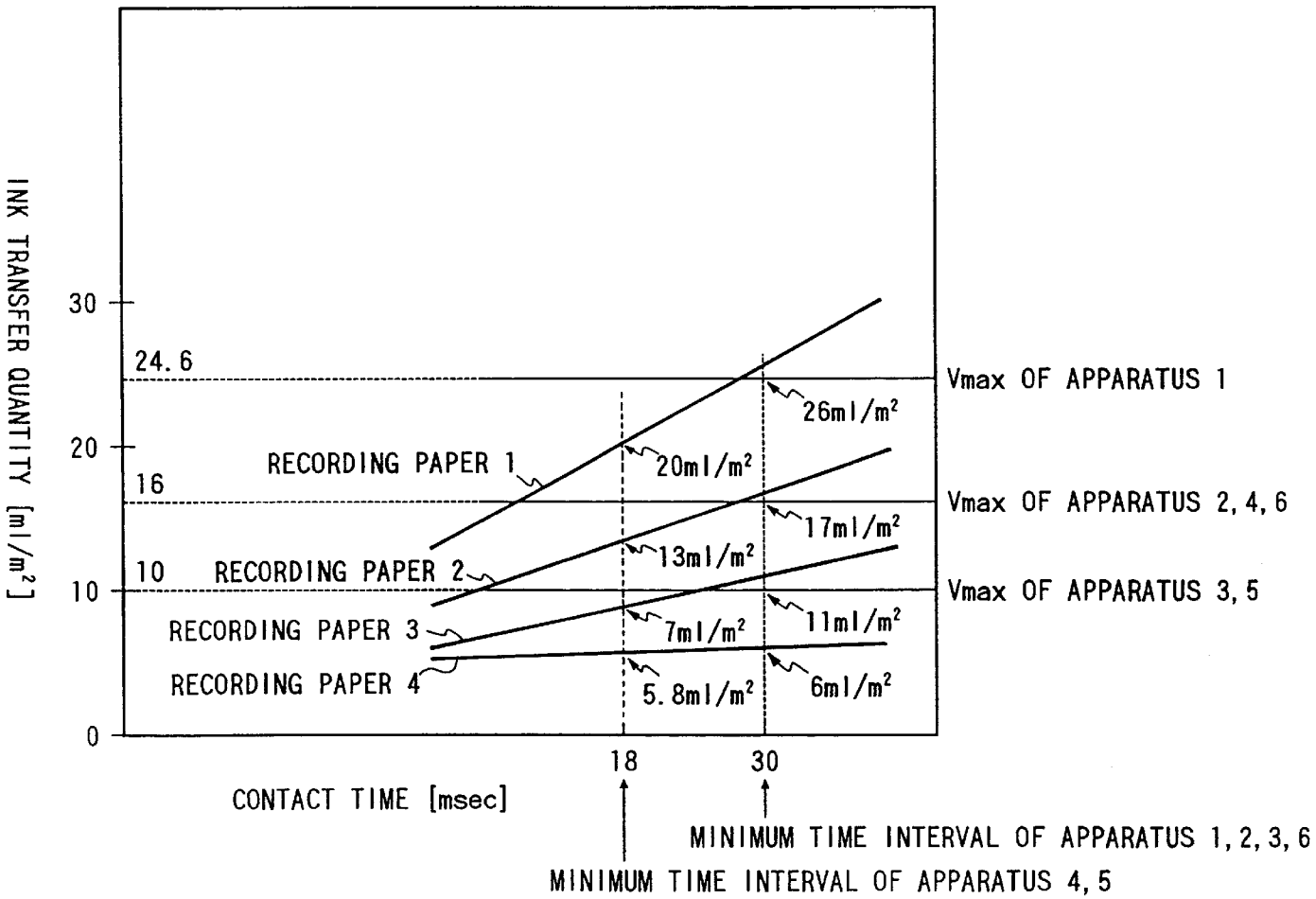
FIG. 4 shows Bristow's test results on a recording paper prepared in an Example of the first embodiment.

The recording papers 1 to 4 thus prepared were tested by the Bristow's method to obtain the results as shown in FIGS. 3 and 4. FIG. 3 shows results obtained using the following full-color inks A as test solutions, and FIG. 4 shows results obtained using the following full-color inks B.

| Ink composition: | | |
|---|---|---|
| Inks A (surface tension: 34 dyne/cm): | | |
| Dye* | X | parts |
| Glycerol | 5 | parts |
| Thiodiglycol | 10 | parts |
| Urea | 7 | parts |
| Polyoxyethylene nonylphenyl ether (NOIGEN EA-30, available from Daiichi Chemical Industries, Ltd.) | 1 | part |
| Water | Balance | |
| *Dye: | | |
| Black; C.I. Food Black 2 | 3.5 | parts |
| Yellow; C.I. Direct Yellow 86 | 2 | parts |
| Magenta; C.I. Acid Red 289 | 2.5 | parts |
| Cyan; C.I. Acid Blue 199 | 2.5 | parts |

-continued

| Ink composition: | | |
|---|---|---|
| Inks B (surface tension: 48 dyne/cm): | | |
| Dye* | X | parts |
| Glycerol | 5 | parts |
| Thiodiglycol | 5 | parts |
| Isopropyl alcohol | 4 | parts |
| Water | Balance | |
| *Dye: | | |
| Black; C.I. Food Black 2 | 3.5 | parts |
| Yellow;. C.I. Direct Yellow 86 | 2 | parts |
| Magenta; C.I. Acid Red 35 | 2.5 | parts |
| Cyan; C.I. Acid Blue 199 | 2.5 | parts |

Recording Apparatus:

Images were recorded using recording apparatus mounted with the ink-jet type recording heads described above, utilizing heat energy as an ink ejection source, to evaluate recording suitability. The following seven kinds of apparatus were used as the recording apparatus.

Recording Apparatus 1

A recording apparatus mounted with recording heads having 23.6 recording nozzles per 1 mm. The recording heads are driven at a drive frequency of 10 kHz to eject inks. Average values of the volume of ink droplets ejected from the recording heads for each color were actually measured to obtain the results as follows: Black: 21 pl(picoliter); yellow: 20 pl; magenta: 22 pl; and cyan: 22 pl. When the ink-jet recording was carried out using the recording apparatus 1, the maximum quantity of ink imparted to one picture element was 44 pl, which was a quantity at the time of blue-color printing (a mixed color of magenta and cyan), and the maximum ink quantity of this recording system was 24.6 nl(nanoliter)/mm$^2$.

Recording Apparatus 2

A recording apparatus mounted with recording heads having 14.2 recording nozzles per 1 mm. The recording heads are driven at a drive frequency of 6 kHz to eject inks. Average values of the volume of ink droplets ejected from the recording heads for each color were actually measured to obtain the results as follows: Black: 38 pl; yellow: 41 pl; magenta: 39 pl; and cyan: 39 pl. When the ink-jet recording was carried out using the recording apparatus 2, the maximum quantity of ink imparted to one picture element was 80 pl, which was a quantity at the time of red-color printing (a mixed color of yellow and magenta) and at the time of green-color printing (a mixed color of yellow and cyan), and the maximum ink quantity of this recording system was 16 nl/mm$^2$.

Recording Apparatus 3

A recording apparatus mounted with recording heads having 7.9 recording nozzles per 1 mm. The recording heads are driven at a drive frequency of 3.3 kHz to eject inks. The heads for the respective colors are each so controlled as to have an ink ejection quantity of 80 pl on the average. When the ink-jet recording was carried out using the recording apparatus 3, the maximum quantity of ink imparted to one picture element was 160 pl, and the maximum ink quantity of this recording system was 10 nl/mm$^2$.

In the above recording apparatuses 1 to 3, the minimum ink-shoot time interval for adjacent dots with different colors was 30 msec.

Recording Apparatuses 4 & 5

The same recording apparatus as the recording apparatus 2 except that the drive frequency of the apparatus was changed to 10 kHz was used as recording apparatus 4. The same recording apparatus as the recording apparatus 3 except that the drive frequency of the apparatus was changed to 5.6 kHz was used as recording apparatuses 5. In the recording apparatus 4 and 5, the minimum ink-shoot time interval for adjacent dots with different colors was 18 msec.

Recording Apparatus 6

A recording apparatus mounted with recording heads having 14.2 recording nozzles per 1 mm. The recording heads are driven at a drive frequency of 6 kHz to eject inks. Average values of the volume of ink droplets ejected from the recording heads for each color were actually measured to obtain the results as follows: black: 81 pl; yellow: 38 pl; magenta: 40 pl; and cyan: 39 pl. When the ink-jet recording was carried out using the recording apparatus 6, the maximum quantity of ink imparted to one picture element was 81 pl, which was a quantity at black printed areas, and the maximum ink quantity of this recording system was 16.2 nl/mm$^2$.

Ink-jet recorded images formed using the recording paper, inks and recording apparatus in the combination as shown in Table 1 were evaluated on the following items.

Evaluation Items:

1. Image Density

Solid images of 100% duty were formed using a black ink (ink composition A or B), and their reflection densities after leaving for 12 hours were measured with a reflection densitometer Macbeth RD-918.

2. Bleeding

Black, yellow, magenta, cyan, blue, green and red solid images were printed so as for their respective areas to adjoin to each other, and the degree of bleeding at the boundaries between different colors was visually observed. An instance where the boundaries were distinguishable as straight lines was evaluated as "AA"; an instance where the boundaries were sharp but slightly lacking in straightness of lines, as "A"; an instance where inks mixed with one another to make the boundaries indistinguishable, as "C"; and an instance intermediate between "A" and "C ", as "B".

3. Character Quality Level

Characters "電驚" (Chinese characters with 13 and 22 strokes) were printed in black, yellow, magenta, cyan, blue, green and red colors to make evaluation. An instance where sharp characters with clear edges were formed in all the respective colors was evaluated as "AA"; an instance where sharp characters with clear edges were formed in black, yellow, magenta and cyan colors, but unsharp characters were formed in blue, green and red colors, as "A"; an instance where characters with crushed lines were formed and not legible, or had a very poor quality level, as "C".

Results of the evaluation made on recording papers 1 to 4 are shown in Table 1.

TABLE 1

| Test example No. | | Recording paper | Ink | Recording apparatus | Results of evaluation: Image density | Bleeding | Character quality level | Overall evaluation |
|---|---|---|---|---|---|---|---|---|
| 1 | (Ex. 1) | 1 | A | 1 | 1.52 | AA | A | A |
| 2 | (Ex. 2) | 1 | A | 2 | 1.46 | AA | A | A |
| 3 | (Ex. 3) | 1 | A | 3 | 1.32 | AA | A | A |
| 4 | (Ex. 4) | 2 | A | 1 | 1.58 | A | A | A |
| 5 | (Ex. 5) | 2 | A | 2 | 1.48 | AA | A | A |
| 6 | (Ex. 6) | 2 | A | 3 | 1.33 | AA | A | A |
| 7 | (Cp. 1) | 3 | A | 1 | 1.48 | C | C | C |
| 8 | (Ex. 7) | 3 | A | 2 | 1.51 | A | A | A |
| 9 | (Ex. 8) | 3 | A | 3 | 1.39 | AA | A | A |
| 10 | (Cp. 2) | 4 | A | 1 | 1.31 | C | C | C |
| 11 | (Cp. 3) | 4 | A | 2 | 1.21 | C | C | C |
| 12 | (Ex. 9) | 4 | A | 3 | 1.31 | A | A | A |
| 13 | (Ex. 10) | 1 | B | 1 | 1.63 | A | A(AA)*2 | A |
| 14 | (Ex. 11) | 1 | B | 2 | 1.55 | A | A(AA) | A |
| 15 | (Ex. 12) | 1 | B | 3 | 1.32 | A | A(AA) | A |
| 16 | (Cp. 4) | 2 | B | 1 | 1.49 | C | C | C |
| 17 | (Ex. 13) | 2 | B | 2 | 1.67 | A | A(AA) | A |
| 18 | (Ex. 14) | 2 | B | 3 | 1.32 | A | A(AA) | A |
| 19 | (Cp. 5) | 3 | B | 1 | 1.31 | C | C | C |
| 20 | (Cp. 6) | 3 | B | 2 | 1.21 | C | C | C |
| 21 | (Ex. 15) | 3 | B | 3 | 1.31 | A | A(AA) | A |
| 22 | (Cp. 7) | 4 | B | 1 | 1.25 | C | C | C |
| 23 | (Cp. 8) | 4 | B | 2 | 1.25 | C | C | C |
| 24 | (Cp. 9) | 4 | B | 3 | 1.29 | C | C | C |
| 25 | (Ex. 16) | 1 | B | 4 | 1.52 | A | A(AA) | A |
| 26 | (Ex. 17) | 1 | B | 5 | 1.35 | A | A(AA) | A |
| 27 | (Co. 10) | 2 | B | 4 | 1.45 | C | C | C |
| 28 | (Ex. 18) | 2 | B | 5 | 1.39 | A | A(AA) | A |
| 29 | (Ex. 19) | 1 | BK;B/CMY;A | 6 | 1.63 | AA | A(AA) | AA |
| 30 | (Ex. 20) | 2 | BK;B/CMY;A | 6 | 1.72 | AA | A(AA) | AA |
| 31 | (Cp. 11) | 3 | BK;B/CMY;A | 6 | 1.37 | B*1 | C | C |
| 32 | (Cp. 12) | 4 | BK;B/CMY;A | 6 | 1.38 | C | C | C |

TABLE 1-continued

| Test example No. | | Recording paper | Ink | Recording apparatus | Results of evaluation: Image density | Bleeding | Character quality level | Overall evaluation |
|---|---|---|---|---|---|---|---|---|
| 33 | (Cp. 13) | (1) | B | 2 | 1.25 | AA | A | C |
| 34 | (Cp. 14) | (2) | B | 2 | 1.01 | C | C | C |
| 35 | (Cp. 15) | (3) | B | 2 | 1.59 | A | A(AA) | A |

Ex: Example
Cp: Comparative Example
(1): Base paper of recording paper 1
(2): NP-DRY paper (mfd. by Canon)
(3): Coated paper
*1: Good between colors (other than black), but a little unclear between black and other colors.
*2: (AA) indicates that, in particular, quality level of black characters is good.

Operational Advantages of the Invention in Test Examples:

Operational advantages of the present invention will be more specifically explained with reference to FIGS. 3 and 4 and Table 1.

The test examples 1 to 12 employ combinations of the recording apparatuses 1 to 3 having different maximum ink quantities (Vmax) with the recording processes in which the inks A are used and the minimum ink-shoot time intervals (T1)for adjacent dots are all 30 msec. As is clear from FIG. 3, distinct recorded images can be formed in the test examples employing such a combination that the quantity of ink transfer (VO) at the contact time 30 msec of the recording paper is larger than the Vmax of the recording apparatus.

On the other hand, in the test examples 7, 10 and 11 where the VO of the recording paper is smaller than the Vmax, the bleeding occurs and only images with a poor character quality level can be obtained. In the test examples 10 and 11 where the VO is greatly smaller, image densities are low and no good recorded images are formed.

In contrast thereto, the test examples 13 to 24 are those in which only inks were replaced with the inks B, having a relatively high surface tension. Similar to the above instances, distinct recorded images can be formed in the test examples employing the combination that the quantity of ink transfer (VO) at the contact time 30 msec of the recording paper is larger than the Vmax of the recording apparatus.

As Is also seen from comparison of FIG. 3 with FIG. 4, the quantity of ink transfer in each recording paper shows a lower value when the inks B are used than when the inks A are used. Hence, the relation between the Vmax and the VO at 30 msec is reversed in the combinations of the recording papers with the recording apparatus in the test examples 16, 20 and 24 (corresponding to the test examples 4, 8 and 12). Actually, when the inks B are used in the combinations employed in the test examples 16, 20 and 24, which are the combinations of recording papers and recording apparatus that have enabled formation of distinct images when the inks A are used, it has turned out that the bleeding occurs and only images with a poor character quality level can be obtained, because of improper combinations as recording systems.

In the test examples 25 to 28, the same recording papers and inks are used as those in the test examples 14, 15, 17 and 18 and also the Vmax of the recording apparatus is identical, but there is a difference in the minimum ink-shoot time Interval (T1), where 30 msec is shortened to 18 msec, because of the difference in drive frequency.

As is seen from FIG. 4, the VO of the recording paper 2 is 17 ml/m$^2$ in the case of 30 msec, and 13 ml/m$^2$ in the case of 18 msec. As a result, in the test example 17 employing the combination that the like recording paper and inks are used and also the Vmax of the recording apparatus is identical, good recorded images are formed, and, on the other hand, in the test example 27, it has turned out that the bleeding occurs and only images with a poor character quality level can be obtained, because of an improper combination as a recording system.

The test examples 29 to 32 are instances where the recording apparatus 6 is used and two kinds of inks (A and B) are mixed.

In these instances, the Vmax of the inks A (blue areas) is 15.9 nl/mm$^2$ and the Vmax of the ink B (black areas) is 16.2 nl/mm$^2$, which are substantially identical. As is seen from FIGS. 3 and 4, in the recording paper 3, the VO at T1=30 msec is sufficient with respect to the Vmax in the case of the inks A, but shows a value lower than the Vmax in the case of the ink B. The test example 31 using the recording paper 3 and the recording apparatus 6 shows the results that the bleeding occurs at the boundaries between black areas and red, green and blue areas, black characters show a poor quality level and only indistinct images are formed.

In these instances, it is necessary to take measures such that a recording paper with a high VO is used, the Vmax for black ink is adjusted to be not larger than the VO of the recording paper 3, an ink with a lower surface tension is used as the black ink, and the drive frequency is lowered to make the minimum time interval larger.

In the test examples 29 and 30, both the black character quality level and the bleeding-freeness are particularly good even when compared with the test examples 2, 5, 14 and 17 in which the like recording paper is used.

The test example 33 is an instance where the base paper of the recording paper 1 is used as a recording paper as it is, and the surface of the recording paper is overall covered with pulp fibers. In this instance, the paper has good bleeding-free properties but shows an insufficient image density.

The test example 34 is an instance where NP-DRY paper (available from Canon Inc.), which is usual electrophotographic copying paper, is used as a recording paper, and the surface of the recording paper is similarly overall covered with pulp fibers. In this instance, only images unsatisfactory in every respect are obtained.

The test example 35 is an instance where Pixel Jet Coated Paper, available from Canon Inc., which is a conventional ink-jet recording coated paper, is used. The surface of this recording paper is overall covered with a pigment and no pulp fibers are seen on the surface. In this instance, images with a certain level are obtainable. This paper, however, not only has a hand very far from a feel of plain paper, but also has an unsatisfactory writability, or causes a problem of dusting when images are formed in a large quantity.

Examples of Second Embodiment

Preparation of Recording Paper:

In a mixture obtained by beating 80 parts of LBKP and 20 parts of NBKP in 420 ml of C.S.F. as starting material pulp, 10 parts of silica, 0.4 part of cationized starch, 0.2 part of polyacrylamide (available from Harima Chemicals, Inc.) and 0.25 part of neutral rosin sizing agent (SIZE PINE NT, available from Arakawa Chemical Industries, Ltd.) were mixed to make a recording base paper 5 with a basis weight of 80 g/m$^2$ by a conventional method. In the same starting material composition as the above, the silica was replaced with 10 parts of alumina to make a recording base paper 6 with a basis weight of 81 g/m$^2$ by a conventional method. In the same starting material composition as the one used for the recording paper 5, the silica was replaced with 10 parts of pseudoboehmite to make a recording base paper 7 with a basis weight of 82 g/m$^2$ by a conventional method. In the same starting material composition as the one used for the recording paper 5, the silica was replaced with 10 parts of kaolin (available from Tsuchiya Kaolin Ind., Ltd.) and the neutral rosin sizing agent was mixed in an amount of 0.4 part, to make a recording base paper 8 with a basis weight of 82 g/m$^2$ by a conventional method.

The above recording base papers 5 to 8 were each coated with the following coating solution by bar coating so as to have a dried coating weight of 2 g/m$^2$. Thus, recording papers 5 to 8 were prepared.

Composition of Coating Solution:

| | |
|---|---|
| Finely divided silica (MIZUKASIL P-78D, available from Mizusawa Industrial Chemicals, Ltd.) | 10 parts |
| Polyvinyl alcohol (PVA 105, available from Kuraray Co., Ltd.) | 10 parts |
| water | 80 parts |

The surface configurations of these recording papers were observed on a scanning electron microscope to prove that pulp fibers bared to the surface and pulp fibers covered with particles were present together in portions.

Figure 8:
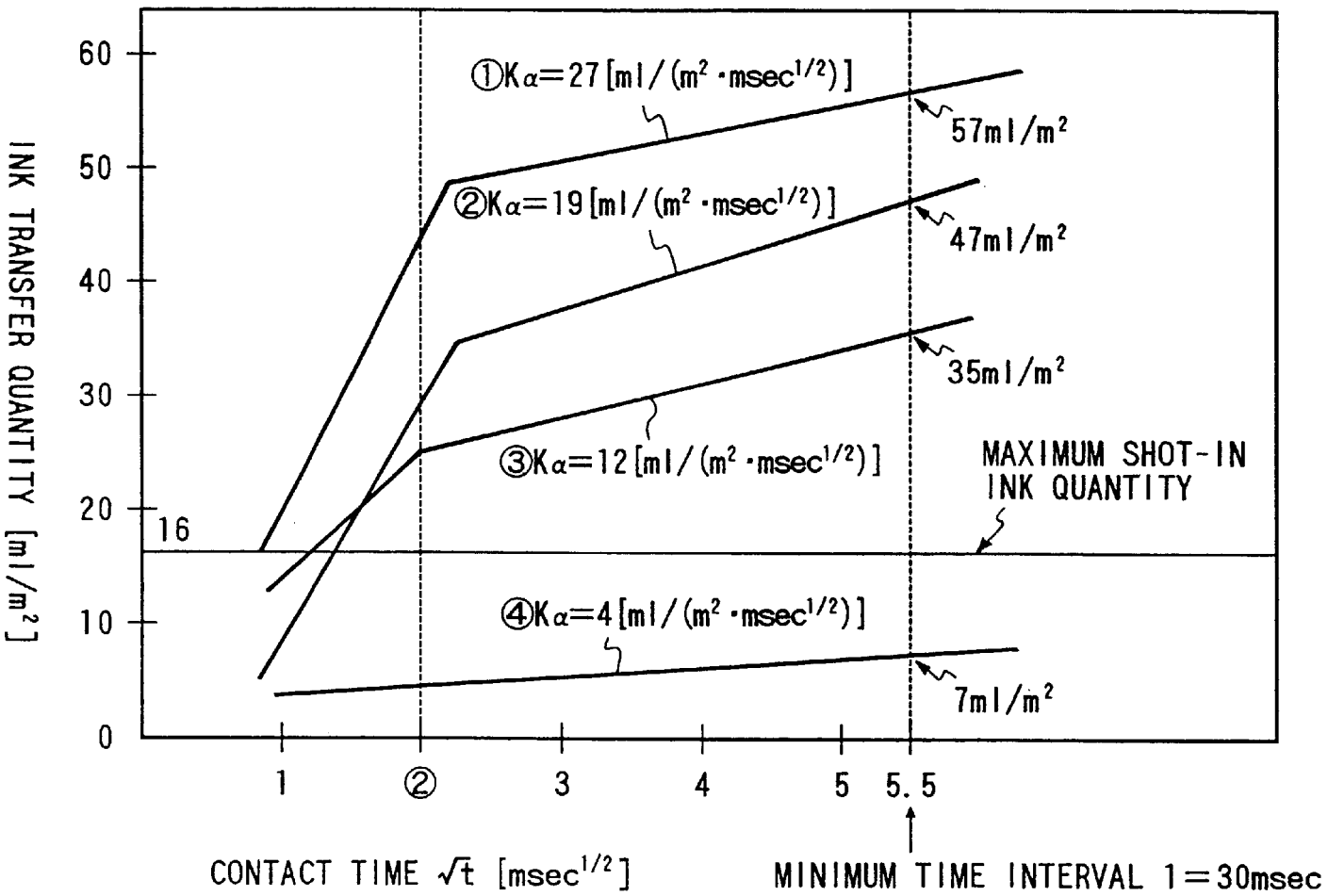
FIG. 8 shows Bristow's test results according to the second embodiment of the present invention.

The recording papers 5 to 8 thus prepared were tested by the Bristow's method to obtain the results as shown in FIG. 8. Measurement was made using the following inks D.

| Ink composition: | | |
|---|---|---|
| Inks C (surface tension: 34 dyne/cm): | | |
| Dye* | X | parts |
| Glycerol | 5 | parts |
| Thiodiglycol | 10 | parts |
| Urea | 7 | parts |
| Acetylene glycol-EO addition product (ACETYLENOL EH, available from Kawaken Fine Chemicals Co., Ltd.) | 1 | part |
| Water | Balance | |
| *Dye: | | |
| Black; C.I. Food Black 2 | 3.5 | parts |
| Yellow; C.I. Direct Yellow 86 | 2 | parts |
| Magenta; C.I. Acid Red 289 | 2.5 | parts |
| Cyan; C.I. Acid Blue 199 | 2.5 | parts |

-continued

| Ink composition: | | |
|---|---|---|
| Inks D (surface tension: 48 dyne/cm): | | |
| Dye* | X | parts |
| Glycerol | 5 | parts |
| Thiodiglycol | 5 | parts |
| Isopropyl alcohol | 4 | parts |
| Urea | 5 | parts |
| Water | Balance | |
| *Dye: | | |
| Black; C.I. Food Black 2 | 3.5 | parts |
| Yellow; C.I. Direct Yellow 86 | 2 | parts |
| Magenta; C.I. Acid Red 35 | 2.5 | parts |
| Cyan; C.I. Acid Blue 199 | 2.5 | parts |

Recording Apparatus:

Images were recorded using a recording apparatus mounted with the ink-jet type recording heads described above, utilizing heat energy as an ink ejection source, to evaluate recording suitability. The following apparatus was used as the recording apparatus.

A recording apparatus mounted with recording heads having 14.2 recording nozzles per 1 mm. The recording heads are driven at a drive frequency of 6 kHz to eject inks. Average values of the volume of ink droplets ejected from the recording heads for each color were actually measured to obtain the results as follows: black: 38 pl; yellow: 41 pl; magenta: 39 pl; and cyan: 39 pl. When the ink-jet recording was carried out using the recording apparatus, the maximum quantity of ink imparted to one picture element was 80 pl, which was a quantity at the time of red-color printing (a mixed color of yellow and magenta) and at the time of green-color printing (a mixed color of yellow and cyan), and the maximum ink quantity of this recording system was 16 nl/mm$^2$.

Evaluation Items:

1. Image Density

Solid images of 100% duty were formed using a black ink (ink composition C or D), and their reflection densities after leaving for 12 hours were measured with a reflection densitometer Macbeth RD-918.

2. Bleeding

Blue, green and red solid images were printed so as for their respective areas to adjoin to each other, and the degree of bleeding at the boundaries between different colors was visually observed. An instance where the boundaries were distinguishable as straight lines was evaluated as "AA"; an instance where the boundaries were sharp but slightly lacking in straightness of lines, as "A"; an instance where inks mixed with one another to make the boundaries indistinguishable, as "C"; and an instance intermediate between "A" and "C", as "B".

3. Character Quality Level

Characters "電驚" (Chinese characters with 13 and 22 strokes) were printed in black, yellow, magenta, cyan, blue, green and red colors to make evaluation. An instance where sharp characters with clear edges were formed in all the black, yellow, magenta, cyan, blue, green and red colors was evaluated as "A"; an instance where characters with crushed lines were formed and not legible, or had a very poor quality level, as "C".

Results of the evaluation made on recording papers 5 to 8 are shown in Table 2.

TABLE 2

| Test example No. | Recording paper | Ink | Results of evaluation: Image density | Bleeding | Character quality level |
|---|---|---|---|---|---|
| 36 | Ex. 5 | C | 1.46 | AA | A |
| 37 | Ex. 6 | C | 1.48 | AAS | A |
| 38 | Ex. 7 | C | 1.51 | *AA | A |
| 39 | Cp. 8 | C | 1.21 | C | C |
| 40 | Ex. 5 | D | 1.49 | A | A |
| 41 | Ex. 6 | D | 1.52 | A | A |
| 42 | Ex. 7 | D | 1.54 | A | |
| 43 | Cp. 8 | D | 1.25 | C | C |
| 44 | Ex. 5 | Bk;D/CMY;C | 1.49 | AA | A |
| 45 | Ex. 6 | Bk;D/CMY;C | 1.53 | AA | A |
| 46 | Ex. 7 | Bk;D/CMY;C | 1.54 | AA | A |
| 47 | Rf. 8 | Bk;D/CMY;C | 1.23 | B | C |

Ex.: Example
Cp.: Comparative Example
Rf.: Reference Example

Operational Advantages of the Invention in Test Examples:

Operational advantages of the present invention will be more specifically explained with reference to FIG. 8 and Table 2.

In the recording apparatus used in the test examples, the minimum ink-shoot time interval (T1)for adjacent dots is 30 msec (T1=5.5 $msec^{1/2}$) As shown in FIG. 8, the quantity of ink transfer at the minimum ink-shoot time intervals (T1)for adjacent dots, of the base paper used in the recording papers 5 to 7 is larger than the maximum shot-in ink quantity of the recording system.

The recording papers 5 to 7 making use of the base paper having the value of coefficient of absorption Kα that satisfies Kα≧10 makes it possible to obtain highly minute images well free of bleeding and with a good character quality level in every recording system in which the inks C with a low surface tension or the inks D with a high surface tension are used or the both are used in combination.

On the other hand, the recording paper 8 making use of the base paper of Kα<10 shows poor results both in bleeding and character quality level, and has no ink-jet recording suitability.

Examples of Third Embodiment

Preparation of Recording Paper:

In a mixture obtained by beating 80 parts of LBKP and 20 parts of NBKP in 420 ml of C.S.F. as starting material pulp, 10 parts of silica, 0.4 part of cationized starch, 0.2 part of polyacrylamide (available from Harima Chemicals, Inc.) and 0.25 part of neutral rosin sizing agent (SIZE PINE NT, available from Arakawa Chemical Industries, Ltd.) were mixed to make a recording base paper 9 with a basis weight of 80 $g/m^2$ by a conventional method. In the same starting material composition as the above, the silica was replaced with 10 parts of alumina to make a recording base paper 6 with a basis weight of 81 $g/m^2$ by a conventional method. In the same starting material composition as the one used for the recording paper 9, the silica was replaced with 10 parts of pseudoboehmite to make a recording base paper 11 with a basis weight of 82 $g/m^2$ by a conventional method.

In the same starting material composition as the one used for the recording paper 9, the silica was replaced with 10 parts of kaolin (available from Tsuchiya Kaolin Ind., Ltd.) and the neutral rosin sizing agent was mixed in an amount of 0.4 part, to make a recording base paper 12 with a basis weight of 82 $g/m^2$ by a conventional method.

The above recording base papers were each coated with the following coating solution B by bar coating so as to have a dried coating weight of 2 $g/m^2$. Thus, recording papers 9 to 12 were prepared. Similarly, the same base paper as the recording base paper 9 was coated with the following coating solution A to prepare recording paper 13.

Composition of Coating Solution A:

Finely divided silica (MIZUKASIL P-78D, available from Mizusawa Industrial Chemicals, Ltd.) 10 parts
Polyvinyl alcohol (PVA 105, available from Kuraray Co., Ltd.) 10 parts
Water 80 parts Composition of Coating Solution B:

Finely divided silica (MIZUKASIL P-78D, available from Mizusawa Industrial Chemicals, Ltd.) 5 parts
Cationized polyvinyl alcohol (CM-318, available from Kuraray Co., Ltd.) 15 parts
Water 80 parts The surface configurations of these recording papers were observed on a scanning electron microscope to prove that pulp fibers bared to the surface and pulp fibers covered with particles were present together in portions.

The recording papers 9 to 13 thus prepared were tested by the Bristow's method to obtain the results as shown in Table 3. Measurement was made using the following inks E.

Ink composition:

Inks E (surface tension: 48 dyne/cm):

| | |
|---|---|
| Dye* | X parts |
| Glycerol | 5 parts |
| Thiodiglycol | 5 parts |
| Isopropyl alcohol | 4 parts |
| Water | Balance |

*Dye:

| | |
|---|---|
| Black; C.I. Food Black 2 | 3.5 parts |
| Yellow; C.I. Direct Yellow 86 | 2 parts |
| Magenta; C.I. Acid Red 35 | 2.5 parts |
| Cyan; C.I. Acid Blue 199 | 2.5 parts |

Recording Apparatus:

Images were recorded using a recording apparatus mounted with the ink-jet type recording heads described above, utilizing heat energy as an ink ejection source, to evaluate recording suitability. The following apparatus was used as the recording apparatus.

A recording apparatus mounted with recording heads having 14.2 recording nozzles per 1 mm. The recording heads are driven at a drive frequency of 6 kHz to eject inks. Average values of the volume of ink droplets ejected from the recording heads for each color were actually measured to obtain the results as follows: black: 38 pl; yellow: 41 pl; magenta: 39 pl; and cyan: 39 pl. When the ink-jet recording was carried out using the recording apparatus, the maximum quantity of ink imparted to one picture element was 80 pl, which was a quantity at the time of red-color printing (a mixed color of yellow and magenta) and at the time of green-color printing (a mixed color of yellow and cyan), and the maximum ink quantity of this recording system was 10 $nl/mm^2$.

Evaluation Items:

1. Image Density

Solid images of 100% duty were formed using a black ink, and their reflection densities after leaving for 12 hours were measured with a reflection densitometer Macbeth RD-918.

2. Bleeding

Black, yellow, magenta, cyan, blue, green and red solid images were printed so as for their respective areas to adjoin to each other, and the degree of bleeding at the boundaries between different colors was visually observed. An instance where the bleeding was at a level not problematic in practical use was evaluated as "A"; and other instances where it was at a lower level, as "C".

Results of the evaluation made on recording papers 9 to 13 are shown in Table 3.

TABLE 3

| Test example No. | Recording paper | Coefficient of absorption $Ka_1$ | Coefficient of absorption $Ka_2$ | Change point (Th) (msec) | Results of evaluation: Image density | Results of evaluation: Percent of ink run | Results of evaluation: Bleeding | Results of evaluation: Overall evaluation |
|---|---|---|---|---|---|---|---|---|
| 48 | 9 | 2.2 | 9.2 | 12 | 1.62 | 2.43 | A | A |
| 49 | 10 | 3.7 | 6.8 | 12 | 1.68 | 2.50 | A | A |
| 50 | 11 | 4.6 | 8.3 | 12 | 1.63 | 2.52 | A | A |
| 51 | 12 | 0.5 | — | None | 1.25 | 2.02 | C | C |
| 52 | 13 | 10.0 | 16.2 | 24 | 1.46 | 2.93 | A | C |

Operational Advantages of the Invention in Test Examples:

Operational advantages of the present invention will be more specifically explained with reference to Table 3.

In the recording apparatus used in the test examples, the minimum ink-shoot time interval (T1)for adjacent dots is 30 msec. The recording papers 9 to 11 satisfying the conditions of the coefficient of absorption $Ka_1$ and $Ka_2$ and change point Th provide a high image density and also have a low percent of ink run, and hence make it possible to obtain highly minute images with a good character quality level without causing bleeding.

On the other hand, as in the recording paper 12, the one having $Ka_1$ of 5 ml/($m^2$·$msec^{1/2}$) or less but having no change point has a percent of ink run which is too low to make solid areas full, resulting in a low image density, and has a poor rate of ink absorption to cause bleeding.

As in the recording paper 13, the one having $Ka_1$ of 5 ml/($m^2$·$msec^{1/2}$) or more has a large percent of ink run, resulting in a poor character quality level. Since it also has $Ka_2$ of 15 ml/($m^2$·$msec^{1/2}$) or more, it has an excessively good ink absorption, resulting in a low image density.

Thus, the recording paper of the present invention, prepared in the manner described above, and the recording process making use of such recording paper make it possible to achieve a high color forming performance and a good character quality level without causing bleeding, as required, in particular, for full-color ink-jet recording paper, and to form images having a water fastness, comparable to those formed on coated paper.

The present recording paper may also cause no paper dust due to fall of coat layers and has the hand like plain paper.

Moreover, the present recording paper can be also used as recording paper for electrophotographic recording, thermal transfer recording and impact recording, can be also used as writing paper writable with ball point pens, pencils or the like, having high general-purpose properties, and can be provided at a very low cost compared with coated paper.

What is claimed is:

1. A recording paper comprising a base paper mainly composed of pulp fibers and a filler, i) coated with a coating solution containing particles, to have a surface where pulp fibers bared to the surface and pulp fibers covered with particles are present together in portions, and ii) wherein the base paper has a coefficient of absorption $K\alpha$ of not less than 10 ml/($m^2$·$msec^{1/2}$) at a contact time of not longer than 4 msec as measured by the Bristow's test method using an ink having a surface tension of 45 to 50 dyne/cm at 25° C.

2. The recording paper according to claim 1, wherein the quantity of ink transfer of the base paper at a minimum ink-shoot time interval for adjacent dots with different colors as measured by the Bristow's test method using an ink having a surface tension of from 45 to 50 dyne/cm is not smaller than a maximum shot-in ink quantity per unit area of the recording system used.

3. A process for producing a recording paper, comprising the step of applying to a base paper mainly composed of pulp fibers and a filler a coating solution containing particles, to produce a recording paper having a surface where pulp fibers bared to the surface and pulp fibers covered with particles are present together in portions; said base paper having a coefficient of absorption Ka of not less than 10 ml/($m^2$·$msec^{1/2}$) at a contact time of not longer than 4 msec as measured by the Bristow's test method using an ink having a surface tension of 45 to 50 dyne/cm at 25° C.

* * * * *

UNITED STATES PATENT AND TRADEMARK OFFICE

CERTIFICATE OF CORRECTION

PATENT NO. : 5,939,210

DATED : August 17, 1999

INVENTOR(S) : MIFUNE HIROSE, ET AL.

It is certified that error appears in the above-identified patent and that said Letters Patent is hereby corrected as shown below:

COLUMN 15:

Line 47, "Is" should read --is--.

COLUMN 19:

Table 2,

| " | |
|---|---|
| AAS | A |
| *AA | A |
| C | C |
| A | A |
| A | A |
| A | " should read |
| --AA | A |
| AA | A |
| C | C |
| A | A |
| A | A |
| A | A--. |

UNITED STATES PATENT AND TRADEMARK OFFICE

CERTIFICATE OF CORRECTION

PATENT NO. : 5,939,210

DATED : August 17, 1999

INVENTOR(S) : MIFUNE HIROSE, ET AL.

It is certified that error appears in the above-identified patent and that said Letters Patent is hereby corrected as shown below:

COLUMN 20:

Line 8, "Finely divided silica (MIZUKASIL P-78 D, available from" should read

-- Finely divided silica (MIZUKASIL P-78D, available from Mizusawa Industrial Chemicals, Ltd. 10 parts--.

Lines 10-11,

" Mizusawa Industrial Chemicals, Ltd. 10 parts" should be deleted.

UNITED STATES PATENT AND TRADEMARK OFFICE

CERTIFICATE OF CORRECTION

PATENT NO. : 5,939,210

DATED : August 17, 1999

INVENTOR(S) : MIFUNE HIROSE, ET AL.

It is certified that error appears in the above-identified patent and that said Letters Patent is hereby corrected as shown below:

COLUMN 22:

Line 44, "Ka" should read --Kα--.

Signed and Sealed this

Twenty-fifth Day of July, 2000

*Attest:*

*Attesting Officer*

Q. TODD DICKINSON

*Director of Patents and Trademarks*